United States Patent [19]

Wissmann

[11] 4,408,587

[45] Oct. 11, 1983

[54] FUEL INJECTION SYSTEM

[75] Inventor: Michael Wissmann, Gerlingen, Fed. Rep. of Germany

[73] Assignee: Robert Bosch GmbH, Stuttgart, Fed. Rep. of Germany

[21] Appl. No.: 236,384

[22] Filed: Feb. 20, 1981

[30] Foreign Application Priority Data

Feb. 20, 1980 [DE] Fed. Rep. of Germany ..... 3006258

[51] Int. Cl.[3] ..... F02M 39/00

[52] U.S. Cl. ..... 123/454; 123/456

[58] Field of Search ..... 123/452–456

[56] References Cited

U.S. PATENT DOCUMENTS

| | | | |
|---|---|---|---|
| 3,946,714 | 3/1976 | Eckert et al. | 123/456 |
| 4,018,200 | 4/1977 | Stumpp et al. | 123/454 |
| 4,227,502 | 10/1980 | Steinwart et al. | 123/454 |

*Primary Examiner*—Craig R. Feinberg

*Attorney, Agent, or Firm*—Edwin E. Greigg

[57] ABSTRACT

A fuel injection system is proposed which is triggerable in such a way that in the presence of control signals, in particular those characterizing engine overrunning, the fuel injection is interrupted. The fuel injection system includes metering valves to each of which one regulating valve is assigned, the valves each having a movable valve element which can be subjected on the one hand to the fuel pressure downstream of the respective metering valve and a spring and on the other hand to the pressure in a control pressure line. In the fuel supply line a pressure-reduction valve is provided upstream of the metering valve. During engine overrunning, the fuel pressure in the control pressure line is controllable by means of an electromagnetic valve in such a way that the fuel pressure in the control pressure line increases and the regulating valves close as a result of which the fuel injection is interrupted.

1 Claim, 4 Drawing Figures

FIG.2
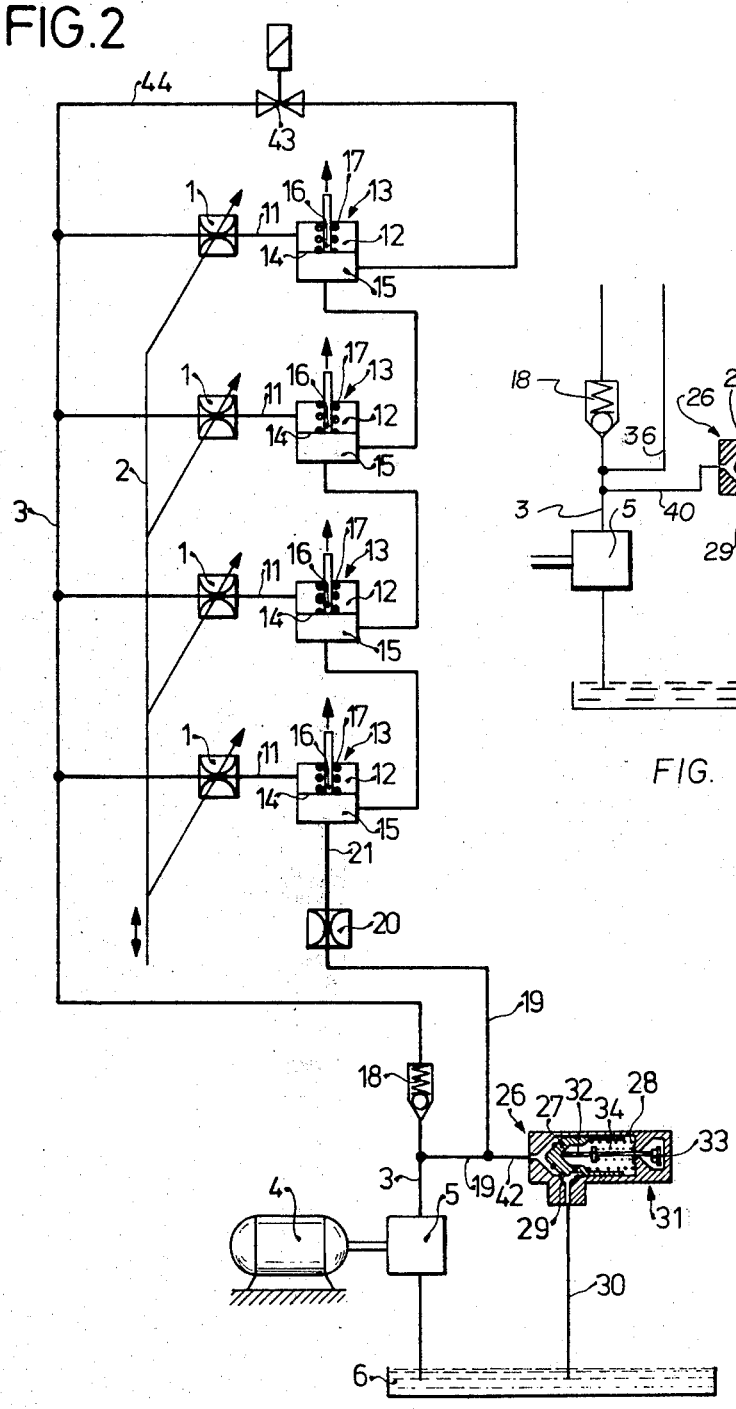
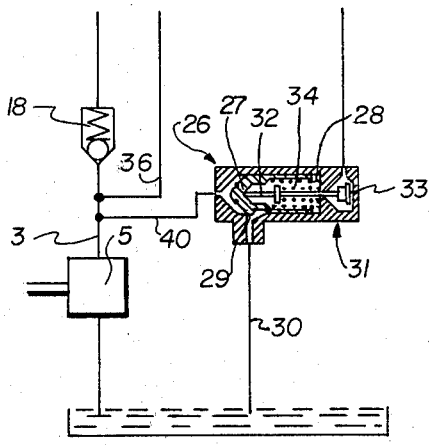
FIG. 1A

FUEL INJECTION SYSTEM

BACKGROUND OF THE INVENTION

The invention is based on a fuel injection system of the general type as described hereinafter. A fuel injection system is already known in which a bypass around the throttle valve is closed during overrunning. However, this does not assure that during engine overrunning the metering of fuel will be reliably interrupted, so as to reduce fuel consumption and reduce the production of toxic exhaust components.

OBJECT AND SUMMARY OF THE INVENTION

The fuel injection system according to the invention has the advantage over the prior art that in the presence of predetermined operational states of the engine, particularly overrunning, it is assured that the fuel injection will be reliably interrupted, so that fuel is not needlessly consumed and exhaust gases are not needlessly produced during overrunning.

The invention will be better understood and further objects and advantages thereof will become more apparent from the ensuing detailed description of three preferred embodiments taken in conjunction with the drawings.

BRIEF DESCRIPTION OF THE DRAWINGS

FIG. 1*a* shows a modification of the embodiment shown in FIG. 1;

FIG. 2 shows a second exemplary embodiment of a fuel injection system;

DESCRIPTION OF THE PREFERRED EMBODIMENTS

Figure 1:
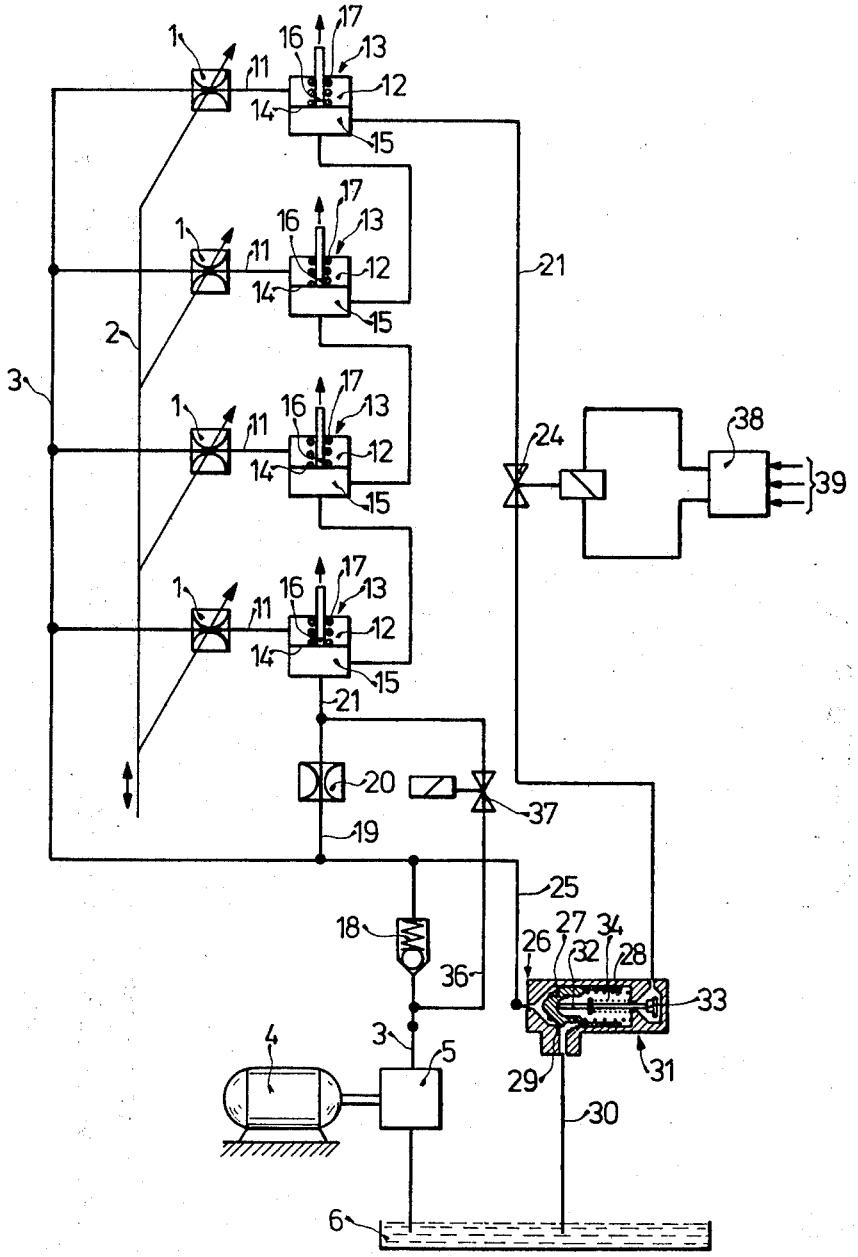
FIG. 1 shows a first exemplary embodiment of a fuel injection system.

In the first exemplary embodiment of a fuel injection system shown in FIG. 1, metering valves 1 are shown, with one metering valve 1 being assigned to each cylinder of the mixture-compressing internal combustion engine having externally-supplied ignition, not shown. At these metering valves 1, a quantity of fuel which is in a predetermined ratio to the quantity of air aspirated by the engine is metered. The fuel injection system shown by way of example has four metering valves 1, and it is thus intended for a four-cylinder engine. The cross section of the metering valves can be varied in common, by way of example, as shown by means of an actuation element 2 in accordance with operating characteristics of the engine, for instance in a known manner in accordance with the quantity of air aspirated by the engine. The metering valves 1 are located in a fuel supply line 3, into which fuel is supplied by a fuel pump 5 driven by an electromotor 4 from a fuel container 6.

Downstream of each metering valve 1, a line 11 is provided by way of which the metered fuel proceeds into a chamber 12 of a regulating valve 13, one of which is separately associated with each metering valve 1. The chamber 12 of the regulating valve 13 is separated by a movable valve element, embodied for instance as a diaphragm 14, from a control chamber 15 of the regulating valve 13. The diaphragm 14 of the regulating valve 13 cooperates with a fixed valve seat 16 provided in the chamber 12, by way of which the metered fuel can flow out of the chamber 12 to the individual injection valves, not shown, in the intake tube of the engine. A spring 17 is also disposed in the chamber 12 and bridges the diaphragm 14 in the opening direction of the regulating valve 13.

A pressure-reduction valve 18, embodied by way of example as a ball valve is disposed in the fuel supply line 3. A pressure drop appears at this pressure-reduction valve 18 which is equal to or greater than the pressure drop appearing at the regulating valve 13.

A line 19 branches off from the fuel supply line 3 downstream of the pressure-reduction valve 18, discharging via a control throttle 20 into a control pressure line 21. The control chambers 15 of the regulating valves 13 are disposed in the control pressure line 21 downstream of the control throttle 20, and an electromagnetically triggerable control pressure valve 24 is disposed downstream of the control chambers 15. A line 25 branches off from the fuel supply line 3 downstream of the pressure-reduction valve 18, having a pressure regulating valve 26 disposed therein, by means of which a constant fuel pressure is maintained upstream of the fuel metering valves 1. The pressure regulating valve 26 shown by way of example in the drawing has a regulating piston 27, which can be displaced by the fuel pressure in the line 25 counter to the force of a regulating spring 28, so that fuel can flow via a regulating edge 29 out of the line 25 into a return flow line 30 and back to the fuel container 6. A blocking valve 31 can simultaneously be opened by the regulating piston 27 as it opens, the blocking valve 31 being disposed directly upstream of the control pressure valves 24 in the control pressure line 21. Thus, the regulating piston 27 of the fuel pump 5 which is supplying fuel as the piston 27 opens, is arranged to engage an actuation pin 32, which displaces the movable valve element 33 in the opening direction, counter to the force of a blocking spring 34. If the engine is shut off, then there is no further fuel supply by the electric fuel pump 4,5, and the pressure regulating valve 26 closes. At the same time, the blocking spring 34 which engages the actuation pin 32 displaces the movable valve element 33 of the blocking valve 31 into the closing position, so that leakage of fuel from the control pressure line 21 is prevented, and the fuel injection system remains filled with fuel, ready for a new start of the engine.

Now in order to assure in the desired manner that no fuel will be injected into the engine during a particular operating status, in particular during engine overrunning, so as to reduce fuel consumption and toxic emissions, a bypass line 36 around the control throttle 20 and the pressure-reduction valve 18 is provided, which connects the fuel supply 3 upstream of the pressure-reduction valve 18 and the control pressure 21 with one another, bypassing the control throttle 20 and the pressure-reduction valve 18. An electromagnetic valve 37 is disposed in the bypass line 36 which is opened only in the presence of predetermined control signals, in particular signals characterizing engine overrunning, and during other operational states of the engine it is closed, for instance, when no electrical current flows through it. Characteristics of engine overrunning, for example, are a throttle valve of the engine located in the idling position as well as an RPM above the engine idling RPM. If the electromagnetic valve 27 is opened, then the fuel pressure of the fuel supply line 3 upstream of the pressure-reduction valve 18 prevails in the control chambers 15 of the regulating valves 13, so that the regulating valves 13 close and prevent the delivery of fuel to the injection valves, because the pressure force in the control chambers 15 on the diaphragm 14 is greater than the pressure force in the chambers 12 and the force of the spring 17 in the opening direction of the regulating valves 13. If the particular operational state, in particular overrunning, has ended, then the electromagnetic valve 37 has no current flowing through it and it closes, so that the control pressure line 21 now communicates with the fuel supply 3 only via the control throttle 20, and the pressure in the control pressure line 21 is determined by the control pressure valve 24.

The electromagnetic valve 37 and the electromagnetically triggerable control pressure valve 24 are triggerable in a known manner by means of an electronic control device 38, into which operating characteristics of the engine such as RPM, throttle valve position, exhaust composition (oxygen sensor) and others can be fed as indicated by the arrows 39. At least the control pressure valve 24 can also be triggered in a clocked manner.

Because the pressure regulating valve 26 regulates the fuel pressure very precisely, it is not necessary to make such stringent requirements for precision of the pressure-reduction valve 18.

Instead of connecting the pressure regulating valve 26, as described above, with the fuel supply line 3 upstream of the pressure-reduction valve 18 by way of the line 25, it is also possible to make this connection by way of a line 40, as indicated by FIG. 1*a*.

In the second exemplary embodiment of the invention shown in FIG. 2, elements which are the same and have the same function as those shown in FIG. 1 for the first exemplary embodiment are given the same reference numerals. In a departure from the first exemplary embodiment, the line 19 in the second exemplary embodiment branches off from the fuel line 3 upstream of the pressure-reduction valve 18, and the pressure regulating valve 26 communicates with the fuel supply line 3 upstream of the pressure-reduction valve 18 via a line 42, which may branch off from the line 19.

The pressure drop at the pressure-reduction valve 18 and the control throttle 20 should be substantially identical. Downstream of the control chambers 15 of the regulating valves 13, an electromagnetic valve 43 is disposed in the control line 21, this valve 43 normally being open, so that fuel can flow out of the control pressure line 21 downstream of the electromagnetic valve 43 into the fuel supply line 3 downstream of the pressure-reduction valve 18 by way of a line 44. In the presence of specific operating states of the engine, and in particular, engine overrunning, the electromagnetic valve 43 can be triggered in a manner described in connection with FIG. 1, such that it closes, and thus the fuel pressure in the control chambers 15 of the regulating valve 13 increases in such a manner that the regulating valves 13 likewise close. In a modification of the exemplary embodiment of FIG. 2, the pressure-reduction valve 18 may be disposed upstream of the pressure regulating valve 26, if the line 19 branches off from the fuel supply line 3 upstream of the pressure-reduction valve 18.

Figure 3:
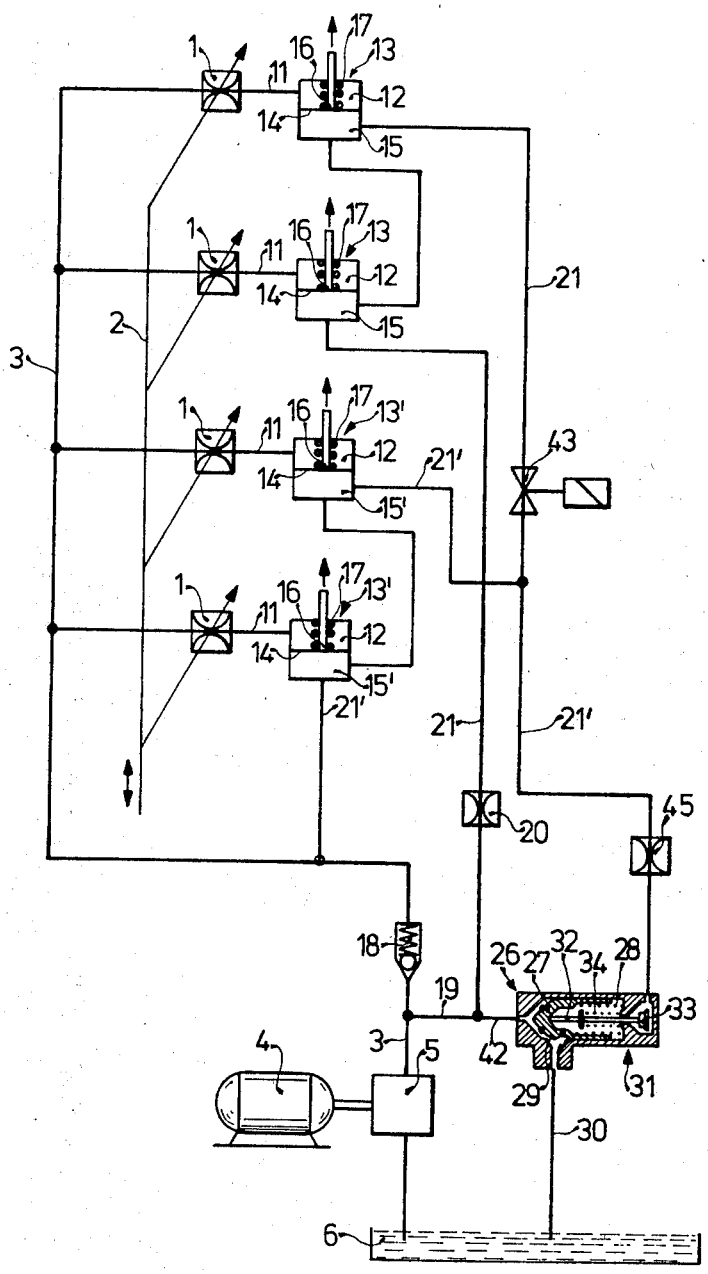
FIG. 3 shows a third exemplary embodiment of a fuel injection system.

In the third exemplary embodiment shown in FIG. 3, the elements remaining the same as in the exemplary embodiments described above are given the same reference numerals. In the third exemplary embodiment shown in FIG. 3, a first control pressure line communicates with the fuel supply line 3 upstream of the pressure-reduction valve 18 via the line 19 and a first control throttle 20. Downstream of the first control throttle 20, at least one control chamber 15 of a regulating valve 13 and one electromagnetic valve 43 are disposed. In the illustrated exemplary embodiment, there are two control chambers 15. The electromagnetic valve 43 closes only in the presence of particular control signals, especially those characterizing engine overrunning, so that the fuel pressure in the control chambers 15 increases and the regulating valves 13 close. The remaining control chambers 15' of the regulating valves 13' are located in a second control pressure line 21, branching off from the fuel supply line 3 downstream of the pressure-reduction valve 18. Downstream of the control chambers 15' a second control throttle 45 is provided by way of which the fuel can proceed to the blocking valve 31 and from there to the return flow line 30. The first control pressure line 21 discharges downstream of the electromagnetic valve 43 into the second control pressure line 21', upstream of the second control throttle 45. The exemplary embodiments of a fuel injection system described thus permits the interruption of the fuel supply only to individual cylinders of the engine in the presence of specific control signals, especially those characterizing engine overrunning, while the remaining cylinders continue to be supplied with fuel.

The foregoing relates to three preferred exemplary embodiments of the invention, it being understood that other other embodiments and varients thereof are possible within the spirit and scope of the invention, the latter being by the appended claims.

What is claimed and desired to be secured by Letters Patent of the United States is:

1. A fuel injection system for mixture-compressing internal combustion engines with external-supplied ignition having metering valves disposed in a fuel supply line for metering a quantity of fuel which is in a specific ratio to the quantity of air aspirated by the engine, wherein the metering is effected at a pressure difference determined by a regulating valve, said regulating valve having a movable valve element disposed downstream of each of said metering valves and arranged to regulate said pressure difference at each of said metering valves, said movable valve element further arranged to be subjected on the one hand to the fuel pressure downstream of the respective metering valve and a spring and on the other hand to the pressure in a control pressure line, a pressure regulating valve arranged to communicate with said fuel supply line between said metering valve and a pressure-reduction valve said last named valve disposed in said fuel supply line upstream of said metering valves, said control pressure line communicates with said fuel supply line via at least one control throttle, and at least one electromagnetic valve is provided to influence the pressure in said control pressure line so that at least a portion of said regulating valve closes, and wherein said control pressure line communicates via said control throttle with said fuel supply line downstream of said pressure-reduction valve, further that said regulating valves have control chambers, and wherein said at least one electromagnetic valve comprises a control pressure valve electromagnetically triggerable in accordance with operating characteristics of said engine disposed downstream of said control throttle, and an electromagnetic valve is located in a bypass line around said control throttle and said pressure-reduction valve, said last named valve arranged to open in the presence of specific control signals, in particular those characterizing engine overrunning.

* * * * *